US006691630B2

(12) United States Patent
Chen

(10) Patent No.: US 6,691,630 B2
(45) Date of Patent: Feb. 17, 2004

(54) LOOPER THREAD TAKE-UP APPARATUS OF A SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/062,504

(22) Filed: Feb. 5, 2002

(65) Prior Publication Data

US 2003/0145771 A1 Aug. 7, 2003

(51) Int. Cl.[7] ..... D05B 49/04
(52) U.S. Cl. ..... 112/248
(58) Field of Search ..... 112/248, 241, 112/254, 249, 302

(56) References Cited

U.S. PATENT DOCUMENTS 1,234,094 A * 7/1917 Drumheller ..... 112/255
1,723,195 A * 8/1929 Moffatt ..... 112/248
2,095,212 A * 10/1937 Clayton ..... 112/248
4,633,795 A * 1/1987 von Hagen ..... 112/248
4,813,363 A * 3/1989 Wacker et al. ..... 112/242
5,732,640 A 3/1998 Mizusaki
6,263,812 B1 * 7/2001 Chen ..... 112/248
6,405,666 B1 * 6/2002 Sahl ..... 112/248

* cited by examiner

*Primary Examiner*—Ismael Izaguirre
(74) *Attorney, Agent, or Firm*—Rosenberg, Klein & Lee

(57) ABSTRACT

A looper thread take-up apparatus of a sewing machine, which is mounted near a side of the machine bed distal from an operator and is adjacent to the lower knotting hook. The looper thread take-up apparatus includes a rotary shaft. One end of the rotary shaft is driven by the lower driving shaft, while the other end of the rotary shaft is coupled with the thread take-up cam.

1 Claim, 5 Drawing Sheets

LOOPER THREAD TAKE-UP APPARATUS OF A SEWING MACHINE

BACKGROUND OF THE INVENTION

1. Field of the Invention

The present invention is related to an improved looper thread take-up apparatus of a sewing machine.

2. Description of the Prior Art

The housing of a conventional sewing machine includes a machine bed, a machine column erecting on right end of the machine bed and a machine arm integrally connected with the top end of the machine column and suspending and leftward extending. A lower driving shaft is mounted in the machine bed and an upper driving shaft is disposed in the machine arm. The lower driving shaft via a toothed belt drives the upper driving shaft, whereby the two driving shafts rotate in accordance with a set timing. A needle bar is fitted through the end of the machine arm. The needle is mounted at bottom end of the needle bar and driven by the upper driving shaft to up and down sew a sewing material. A needle plate is disposed on the machine bed in the needle stroke position. A lower knotting hook is mounted in the machine bed near the needle stroke position. The lower knotting hook is driven by the lower driving shaft and cooperates with the needle to knot the thread and complete the sewing operation.

In order to achieve beautiful seam, in each stitching operation, the looper thread must be properly loosened. Conventionally, a thread take-up cam is mounted on the lower driving shaft. Thread guide plates are respectively mounted on two sides of the thread take-up cam. The looper thread is passed through one thread guide plate and then wound over the rim of the thread take-up cam and then passed through the other thread guide plate and finally passed through the eyelet of the lower knotting hook. The thread take-up cam is driven by the lower driving shaft and cooperatively rotates by one circle in each needle stroke travel. The thread take-up cam serves to pull and take up (that is, loosen) the looper thread. Accordingly, the seam on the sewing material will not crimp.

It is necessary to adjust the length of each thread take-up travel in accordance with the thickness and variety of the sewing material so as to adjust the tension of the looper thread to an optimal extent. Therefore, a convenient adjustment of the looper thread take-up apparatus is required. In addition, the thread take-up cam rotates at high speed so that the looper thread is subject to breakage and tangling in the groove of the thread take-up cam. Under such circumstance, it is necessary to detach the thread take-up cam for clearing up the tangling thread. Then, the thread take-up cam is again mounted on the lower driving shaft. U.S. Pat. No. 6,263,812 filed on Oct. 13, 2000, issued on Jul. 24, 2001, entitled "looper thread take-up structure structure of sewing machine capable of very easily clearing up tangling thread" provides a measure for detaching the cam and easily clearing up the tangling thread in case of tangling of the looper thread in the thread take-up cam.

In addition to the thread take-up cam, many other components are mounted on the lower driving shaft. Therefore, it is a professional task to detach the thread take-up cam from the lower driving shaft of the sewing machine. Moreover, after clearing up the tangling thread, it is necessary to again laboriously install the thread take-up cam back to its home position. Furthermore, after installed back to the home position, it is necessary to again adjust the timings of the respective components. It often takes one or more than one day to complete these procedures. Such complicated works can be hardly independently done by a clothes manufacturer and specialists of the original manufacturer of the sewing machine are required to complete the works.

In order to solve this problem, U.S. Pat. No. 5,732,640 discloses a looper thread take-up apparatus 8 which is mounted on inner side of a leg portion C erected on the machine bed B. In this position, the looper thread take-up apparatus 8 will not hinder other accessories from being installed. In addition, the installation and adjustment of the looper thread take-up apparatus will become more convenient. However, such structure still has a shortcoming as follows:

A take-up section of the looper thread starts from the looper thread take-up apparatus 8 and ends at the needle stroke position. In the above Patent, the looper thread take-up apparatus 8 is mounted inner side of a leg portion C erected on the machine bed B and spaced from the needle stroke position by a quite long distance. That is, the take-up section of the looper thread is very long. It is known that the increased length of the thread in each take-up travel of the looper thread take-up apparatus 8 is limited. The longer the take-up section is, the more limited the increased total length of the take-up section. Moreover, the sewing thread is extensible so that the take-up effect of the above Patent is even poorer than the conventional structure.

SUMMARY OF THE INVENTION

It is therefore a primary object of the present invention to provide an improved looper thread take-up apparatus of a sewing machine, which is mounted on rear side of the machine bed of the sewing machine. Therefore, the looper thread take-up apparatus will not hinder other accessories from being installed. Moreover, the looper thread take-up apparatus is close to the lower knotting hook so that an accurate thread take-up effect can be achieved.

It is a further object of the present invention to provide the above looper thread take-up apparatus which is mounted on rear side of the machine bed of the sewing machine without being obstructed. Therefore, it is convenient to install and adjust the looper thread take-up apparatus.

According to the above objects, the sewing machine has a housing including a machine bed, a machine column and a machine arm. The machine bed has a first side adjacent to an operator, a second side opposite to the first side, a third side connected between two ends of the first side and the second side and a fourth side one end of which is connected with the other end of the first side. A lower driving shaft is disposed in one end of the machine bed. A lower knotting hook is disposed in the machine bed near the other end thereof. The machine column erects on one end of the machine bed and being close to the third side thereof. One end of the machine arm is connected with upper end of the machine column. The machine arm suspends and extends from the machine column toward upper side of the fourth side of the machine bed. The sewing machine further includes a looper thread take-up apparatus which cooperates with the lower knotting hook to loosen the looper thread. The looper thread take-up apparatus includes a thread take-up cam and thread guide plates supported on two sides of the cam.

The looper thread take-up apparatus is mounted near the second side of the machine bed and is adjacent to the lower knotting hook. The looper thread take-up apparatus further includes a rotary shaft. One end of the rotary shaft is driven by the lower driving shaft, while the other end of the rotary shaft is coupled with the thread take-up cam.

The present invention can be best understood through the following description and accompanying drawings wherein:

DETAILED DESCRIPTION OF THE PREFERRED EMBODIMENT

Figure 1:
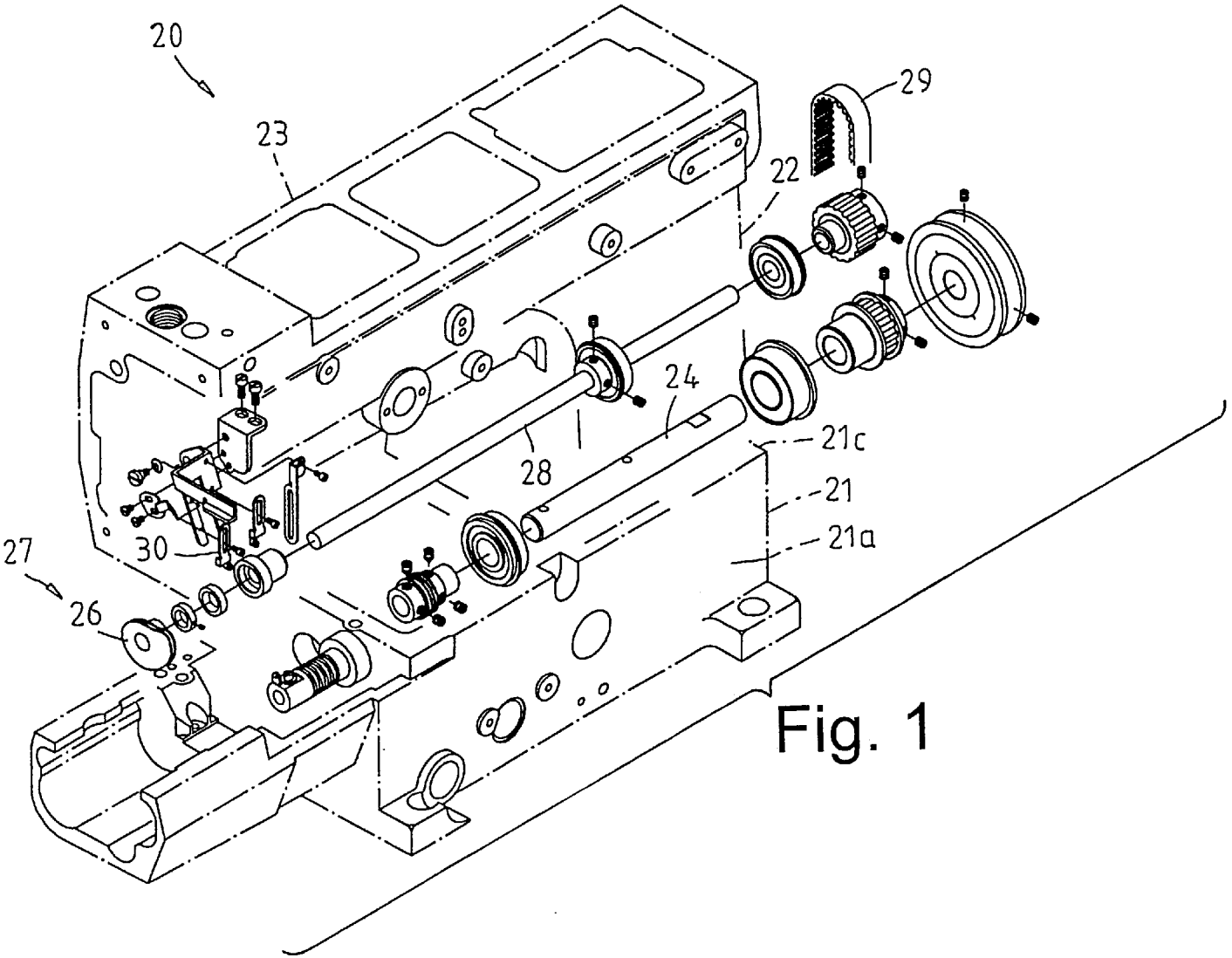
FIG. 1 is a perspective exploded view of the present invention.
Figure 2:
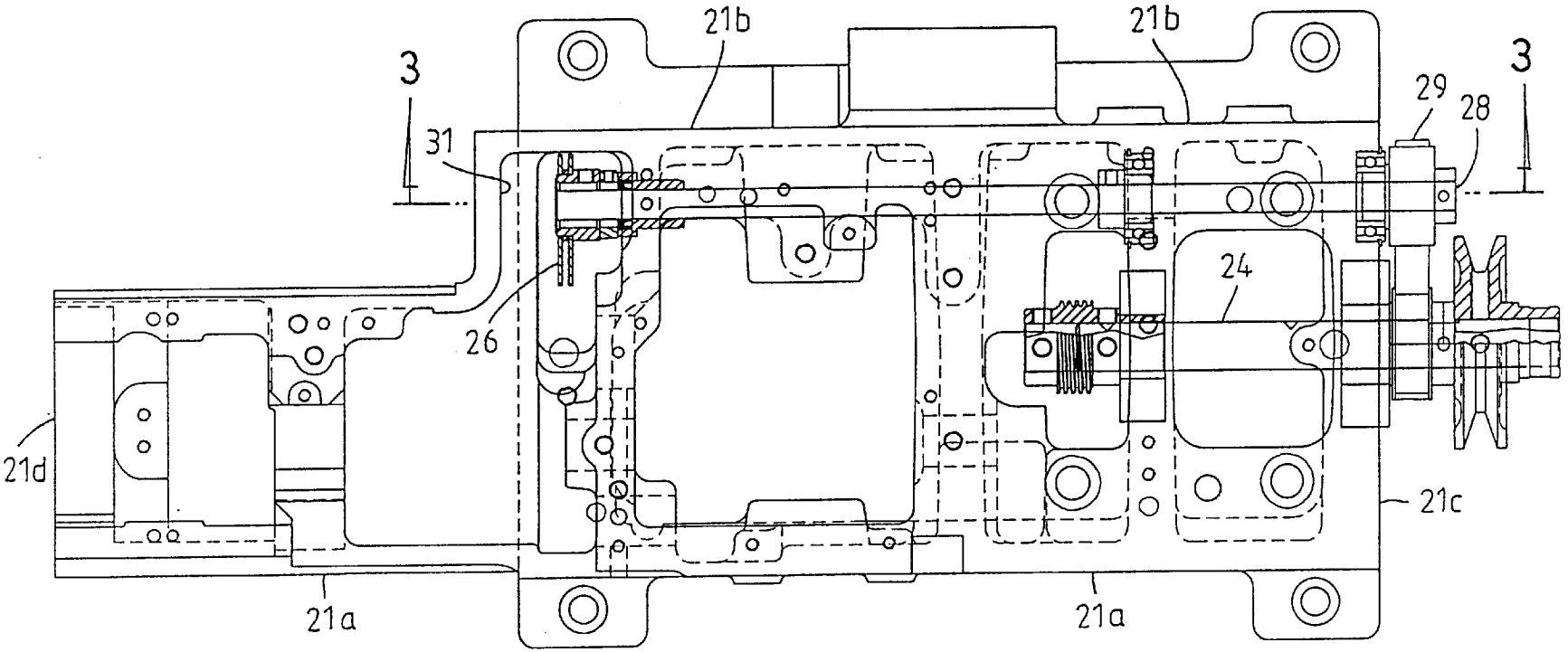
FIG. 2 is a top view of the machine bed of the sewing machine of the present invention.
Figure 3:
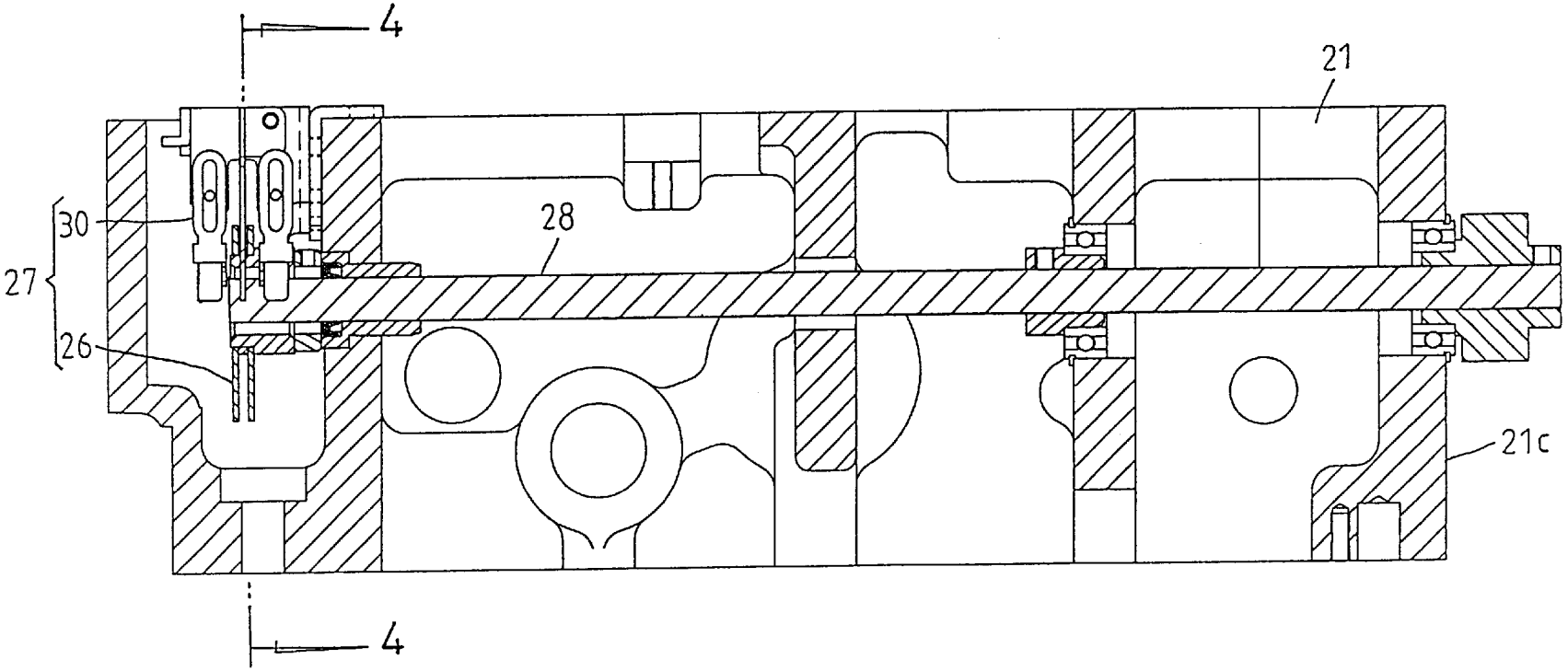
FIG. 3 is a sectional view taken along line 3—3 of FIG. 2.
Figure 4:
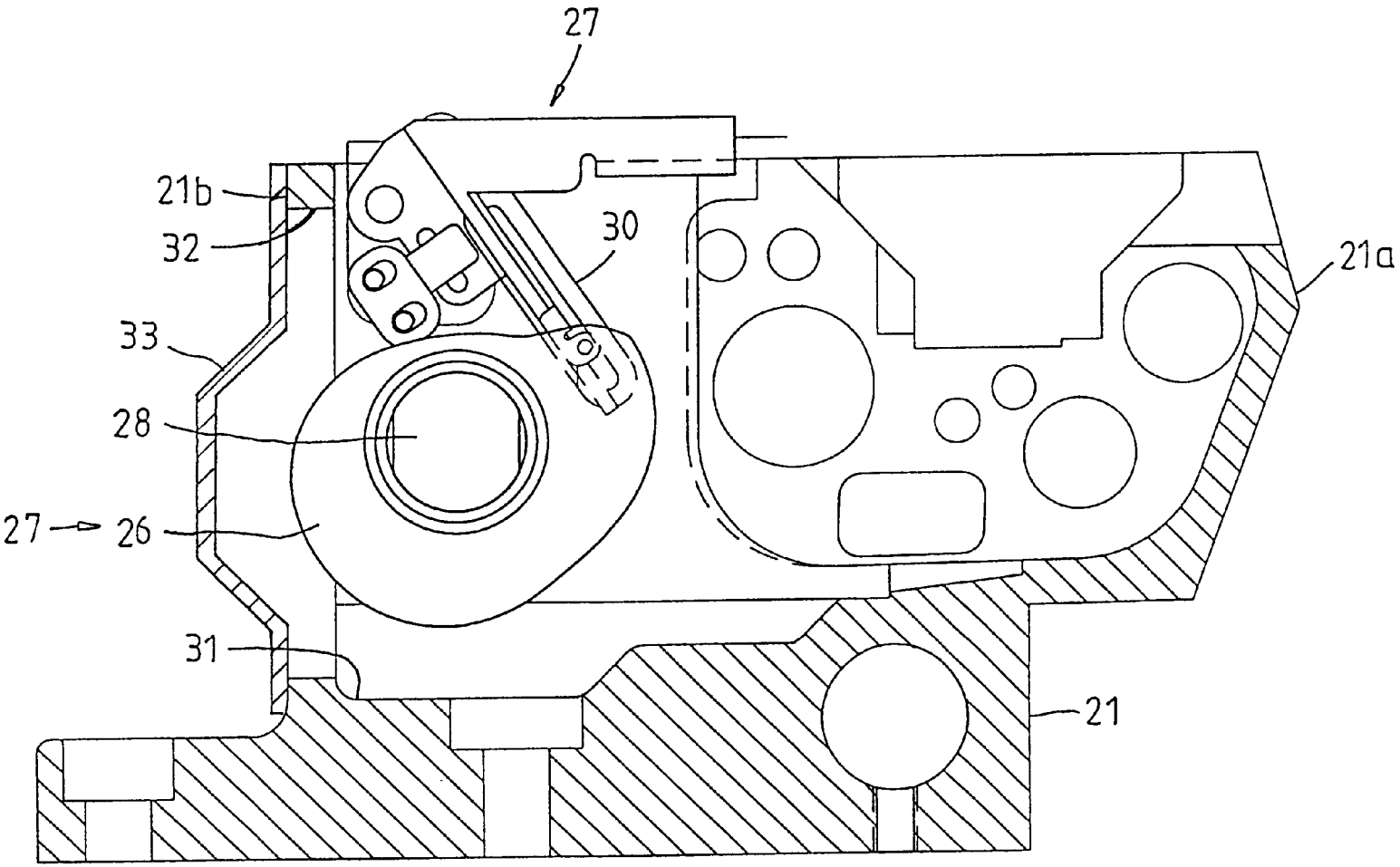
FIG. 4 is a sectional view taken along line 4—4 of FIG. 3.

Please refer to FIGS. 1 to 5. The present invention provides a looper thread take-up apparatus of a sewing machine. The sewing machine has a housing 20 including a machine bed 21, a machine column 22 and a machine arm 23. The machine bed 21 has a first side 21*a* adjacent to an operator, a second side 21*b* opposite to the first side 21*a*, a third side 21*c* connected between two ends of the first side 21*a* and the second side 21*b* and a fourth side 21*d* one end of which is connected with the other end of the first side 21*a*. A lower driving shaft 24 is disposed in one end of the machine bed 21. A lower knotting hook 25 is disposed in the machine bed 21 near the other end thereof. The machine column 22 erects on one end of the machine bed 21 and is close to the third side 21*c* thereof. One end of the machine arm 23 is connected with upper end of the machine column 22. The machine arm 23 suspends and extends from the machine column 22 toward the upper side of the fourth side 21*d* of the machine bed 21. The sewing machine further includes an improved looper thread take-up apparatus 27 which cooperates with the lower knotting hook 25 to loosen the looper thread. The looper thread take-up apparatus 27 includes a thread take-up cam 26 and thread guide plates 30 supported on two sides of the cam 26.

The present invention is characterized in that the looper thread take-up apparatus 27 is mounted near the second side 21*b* of the machine bed 21 and is adjacent to the lower knotting hook 25. In this embodiment, a mounting cavity 31 is formed on the second side 21*b* of the machine bed 21. The mounting cavity 31 has an opening 32 to facilitate installation and adjustment of the looper thread take-up apparatus 27. A sealing cover 33 is used to seal the opening 32. The looper thread take-up apparatus 27 further includes a rotary shaft 28 mounted near the second side 21*b* of the machine bed 21. One end of the rotary shaft 28 is coupled with the lower driving shaft 24 via a toothed belt 29 and driven by the lower driving shaft 24. The other end of the rotary shaft 28 is coupled with the thread take-up cam 26.

Figure 5:
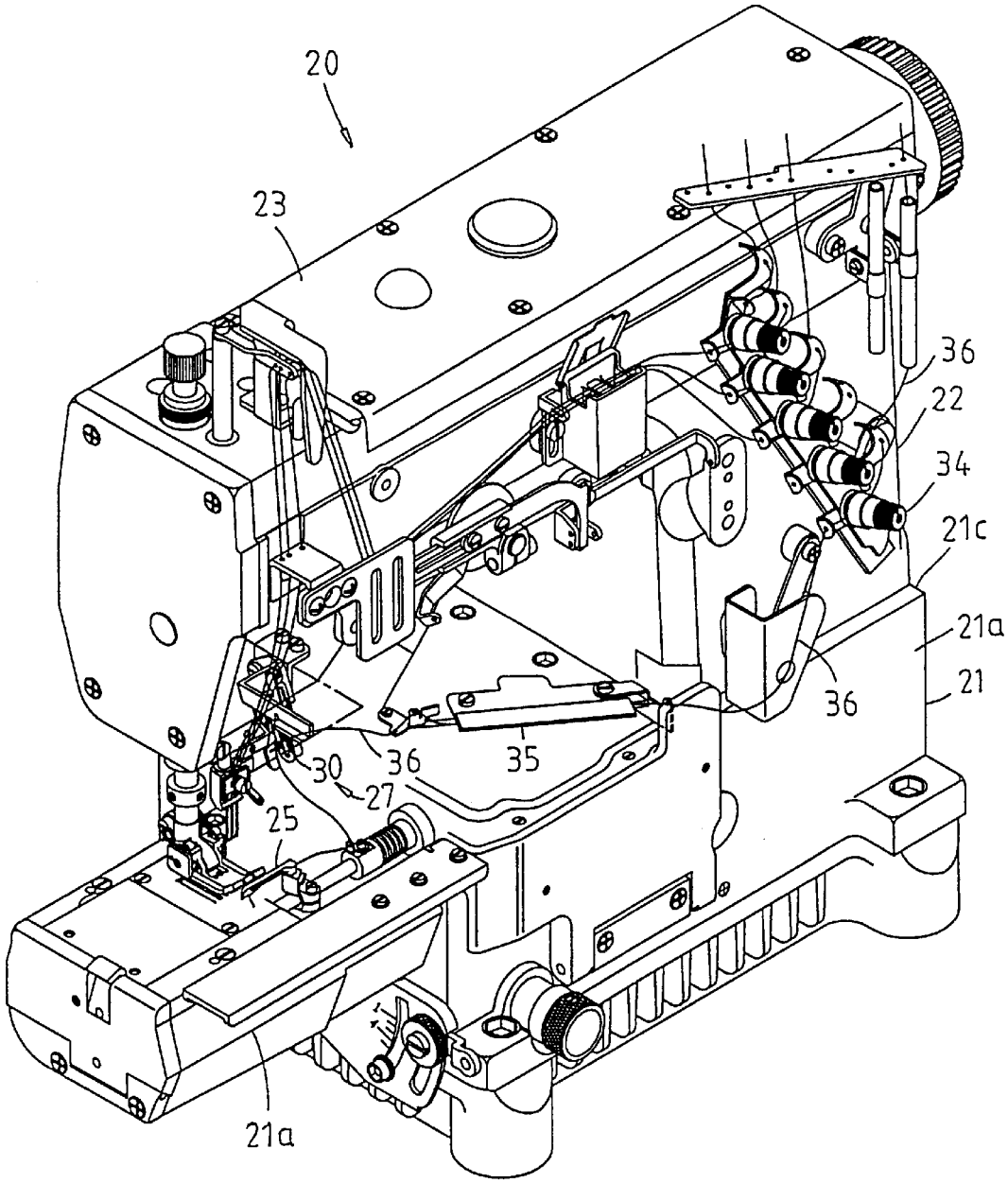
FIG. 5 is a perspective assembled view of the present invention.

Referring to FIG. 5, the looper thread 36 passes through a tension adjustment nut 34 and the thread guide plates 35 and then passes through the looper thread take-up apparatus 27. After passing through the looper thread take-up apparatus 27, the looper thread 36 immediately passes through the lower knotting hook 25 adjacent to the looper thread take-up apparatus 27. Therefore, the thread take-up section is formed between the looper thread take-up apparatus 27 and the lower knotting hook 25. Therefore, the thread take-up section is very short and a very good thread take-up effect is achieved.

According to the above arrangement, the looper thread take-up apparatus of sewing machine of the present invention has the following advantages:

1. The looper thread take-up apparatus of the present invention is mounted on rear side of the machine bed of the sewing machine. Therefore, the looper thread take-up apparatus will not hinder other accessories from being installed. Moreover, the looper thread take-up apparatus is close to the lower knotting hook so that the thread take-up effect is very good.
2. looper thread take-up apparatus of the present invention is mounted on rear side of the machine bed of the sewing machine without being obstructed. Therefore, it is convenient to install and adjust the looper thread take-up apparatus.

The above embodiment is only used to illustrate the present invention, not intended to limit the scope thereof. Many modifications of the above embodiment can be made without departing from the spirit of the present invention.

What is claimed is:

1. A looper thread take-up apparatus of a sewing machine, the sewing machine comprising a housing including:

(a) a machine bed having a first side adjacent to an operator, a second side opposite to the first side, a third side connected between two ends of the first side and the second sides, and a fourth, sides one end of the fourth side being connected with an other end of the first side, a lower driving shaft being disposed in one end of the machine bed, a lower knotting hook being disposed in the machine bed near an other end thereof, the machine bed having a mounting cavity formed therein adjacent the second side thereof, the mounting cavity having an opening at one end thereof;

(b) a machine column extending from one end of the machine bed and being adjacent to the third side thereof; and (c) a machine arm having one end connected with upper end of the machine column, the machine arm being suspended from the machine column and extending toward an upper side of the fourth side of the machine bed;

the sewing machine further comprising a looper thread take-up apparatus which cooperates with the lower knotting hook to loosen the looper thread and is disposed in the cavity, the looper thread take-up apparatus being accessible for installation and adjustment through the cavity opening, the looper thread take-up apparatus including (i) a rotary shaft having a first end rotatively driven by the lower driving shaft, a second end of the rotary shaft being defined by a cantilevered portion of the rotary shaft, (ii) a thread take-up cam coupled to the cantilevered portion of the rotary shaft, and (iii) a pair of thread guide plates respectively supported on two sides of the cam, said looper thread take-up apparatus being mounted near the second side of the machine bed and being adjacent to the lower knotting hook.

* * * * *